United States Patent [19]

Keeney

[11] 4,199,080

[45] Apr. 22, 1980

[54] INPUT MONITORING SYSTEM FOR SAND CLASSIFYING TANK

[75] Inventor: Robert B. Keeney, Des Moines, Iowa

[73] Assignee: Eagle Iron Works, Des Moines, Iowa

[21] Appl. No.: 917,748

[22] Filed: Jun. 22, 1978

[51] Int. Cl.[2] ..... B67D 5/08

[52] U.S. Cl. ..... 222/23; 222/30; 222/64; 222/70

[58] Field of Search ..... 222/64, 70, 23, 30, 222/39, 40, 76, 129, 132, 144.5; 209/156

[56] References Cited

U.S. PATENT DOCUMENTS

| | | | |
|---|---|---|---|
| 3,114,479 | 12/1963 | Keeney | 222/64 |
| 3,123,252 | 3/1964 | Kuntz | 222/30 |
| 3,913,788 | 10/1975 | McCauley | 222/64 |

*Primary Examiner*—H. Grant Skaggs

*Attorney, Agent, or Firm*—Kinzer, Plyer, Dorn & McEachran

[57] ABSTRACT

A monitoring system for a water scalping sand classifying tank, comprising timers for measuring the cumulative total discharge times for at least two key classification stations of the tank over an extended period of time which may include many reblend cycles for the tank. Tolerance limits are established by use of at least two timers for each key station. Any extended variation in the desired ratio of total discharges for the key stations, indicating an input change requiring correction, is signalled by an indicator system coupled to the timers.

10 Claims, 7 Drawing Figures fig. 1.
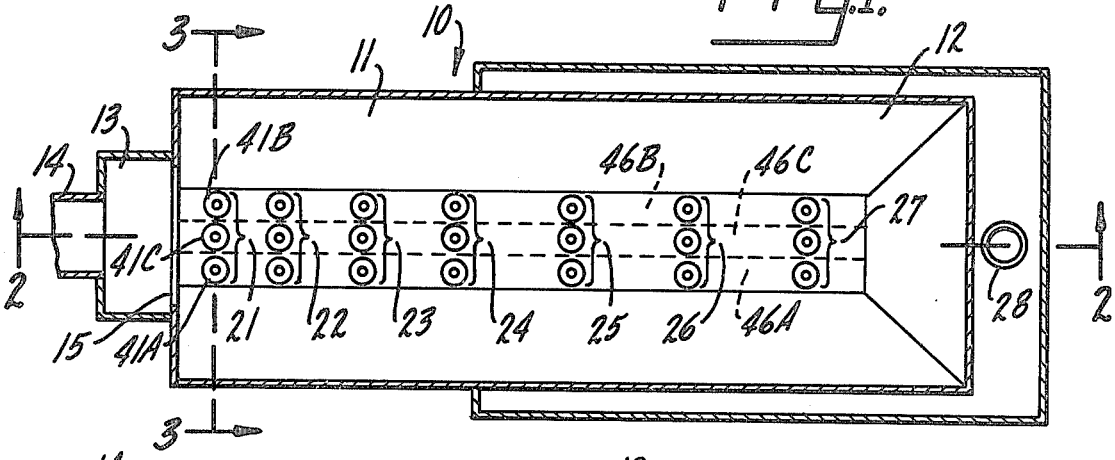
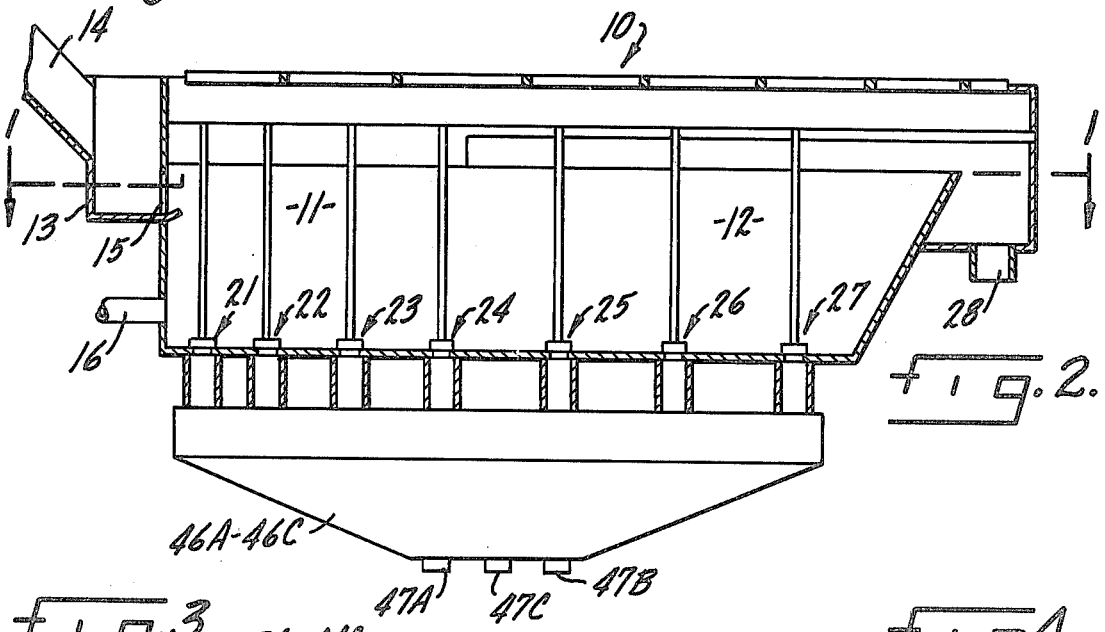
fig. 2.
fig. 3.
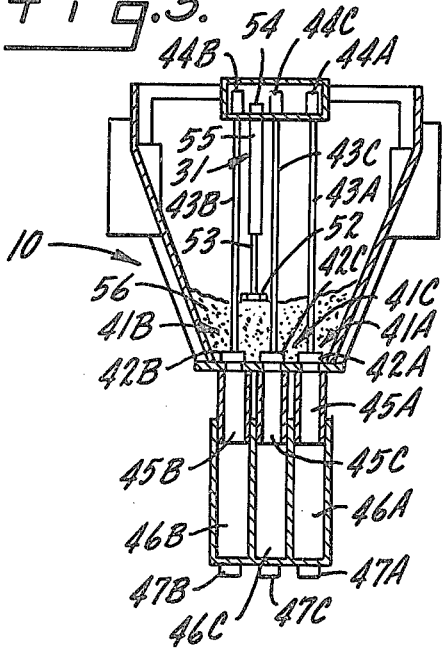
fig. 4.
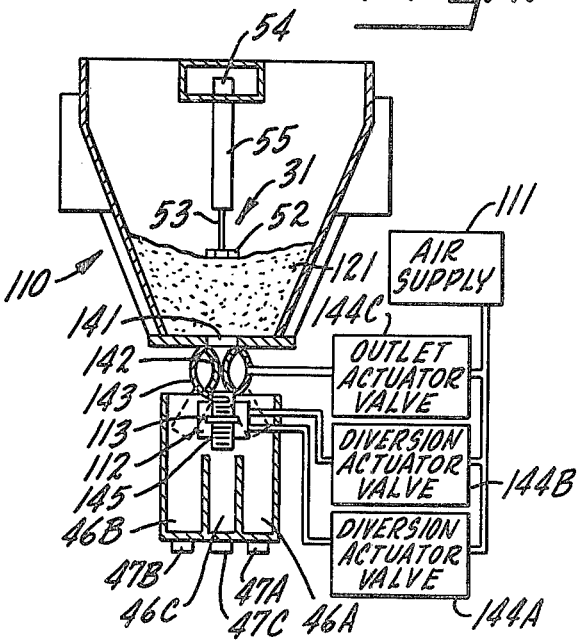

INPUT MONITORING SYSTEM FOR SAND CLASSIFYING TANK

BACKGROUND OF THE INVENTION

In a water scalping tank, employed for classification and reblending of sand or other water-insoluble granular material, a slurry of sand and water is introduced into one end of an elongated tank; the larger particles settle to the bottom near the input end and progressively finer particles settle out toward the opposite (overflow) end of the tank. A series of classification stations for discharge of sand are spaced longitudinally of the tank. Sand is permitted to accumulate to a substantial depth at each station and is then discharged to one or more reblending flumes. The tank may include one flume for blending a controlled specification product and a second flume for an uncontrolled residual product constituting excess sand not used in the specification product. In many instances, the tank has three flumes, which may be used to produce two controlled specification products flumes and an uncontrolled residual product.

The water scalping tank serves three basic functions. One is to remove excess water from the sand or other granular material; the second is to classify the sand into various sizes. The third function is to reblend these different sand sizes in predetermined ratio to meet a quantitative specification. Ideally, the tank would separate the sand into non-overlapping sizes. In actual practice, the sand discharged at each classification station may include several different particles sizes, but there is sufficient differentiation in particle size between the stations to permit reblending within rather closely controlled tolerances.

The most common reblending control for a water scalping tank or similar classifying and reblending apparatus comprises a series of manually adjustable splitter gates, one for each classification station, dividing the output between controlled product(s) and an uncontrolled residual product. However, variations in the gradation of the material fed to the tank may necessitate frequent sampling of the reblended controlled products, followed by manual readjustment of the splitter gates to hold their compositions within specifications. This sampling and readjustment operation is time consuming and wasteful.

One alternative to manual splitter gate control for the reblending operation of a classifying tank provides for multiple outlet valves at each classification station. Timing control is applied to those valves, varying the duty cycles of the outlets to produce one or more controlled products and a residual product. A particularly successful example of this kind of control is disclosed in Keeney U.S. Pat. No. 3,114,479, issued Dec. 17, 1963.

Another quite successful automated control for a classifying tank, of a more sophisticated nature, is described in Cochran U.S. Pat. No. 3,160,321, issued Dec. 8, 1964. In the Cochran system, the specification product is produced in a series of batches. The quantitative ratio between the amounts of sand discharged from the classification stations to each specification product is determined directly by individual timers, one for each product at each classification station; all timers for each controlled product must time out before a new batch of that product is started. The Cochran system also provides an effective tolerance control, utilizing a maximum timer and a minimum timer for each classification station of the tank. A similar batch control, applied to a tank in which each classification station has a single outlet valve followed by a diversion valve for directing the flow to two or more different flumes, is shown in Archer U.S. Pat. No. 3,467,281.

A continuous-operation automated tank control system is described in McCauley U.S. Pat. No. 3,913,788, issued Oct. 21, 1975. In that system, one classification station is designated a master station. Discharge at each station is initiated whenever sufficient material has accumulated to allow a relatively constant flow. Each station has a digital timer for measuring its flow to the specification product; the time of flow for the master station is continuously compared with the flow time for each secondary station in a pre-set ratio that may be different for each secondary station. When the comparison for any secondary station shows excessive cumulative flow from that station, its discharge is diverted from the specification flume to the auxiliary flume, but only until the master station flow catches up. When the comparison for any secondary station shows an inadequate cumulative flow, the master station discharge is diverted to the auxiliary flume until the secondary stations have all caught up.

In any of these different classifying tank controls, considerable difficulties may be encountered if the size gradation of the input to the tank changes substantially, as when a sand dredge moves from one part of a deposit to another. When such a change occurs, the manual splitter gate control or the duty-cycle control of the Keeney patent may no longer be able to maintain the controlled products within permissible tolerances. The Cochran control can still produce the controlled products, but may divert excessive quantities of sand to the uncontrolled auxiliary product. Similar difficulties can occur in the Archer and McCauley systems. In many installations, these problems could be averted if changes in input gradation were identified in a reasonable time.

SUMMARY OF THE INVENTION

It is a principal object of the invention, therefore, to provide a new and improved system for monitoring the input to a sand classifying tank or like classifying apparatus, which will inform the tank operator of substantial changes in the gradation of the tank input and enable the operator to take corrective measures.

Another object of the invention is to provide a new and improved input monitoring system for a sand classifying tank that can be used in conjunction with virtually any reblending control, including all of those discussed above.

A further object of the invention is to provide a new and improved input monitoring system for a sand classifying tank that can be utilized as an auxiliary override control to maximize continued production of controlled specification products when a substantial change in input gradation occurs, and that also informs the tank operator of the nature of the input change so that corrective action can be taken.

Accordingly, the invention relates to an input monitoring system for a sand classifying tank or like apparatus for classifying granular material, of the kind including a series of classification stations at which different gradations of material accumulate at varying rates, each station having controlled product outlet means for discharging material to at least one controlled product and residual outlet means for discharging material to an uncontrolled product. The classifying tank further comprises a series of level sensors, one for each classification station, each level sensor actuating the outlet means at its classification station to discharge material whenever material has accumulated to a given level at that station, and product control means for controlling the relative amounts of material discharged through the controlled product outlet means of the classification stations to produce a controlled product of predetermined constituency, within given tolerances. The monitoring system of the invention comprises first discharge monitoring means for measuring the cumulative total discharge, at a first key classification station, and second discharge monitoring means for measuring the cumulative total discharge, at a second key classification station. Imbalance indicator means are coupled to the monitoring means, for detecting and indicating any extended variation in the ratio of total cumulative discharges for the key classification stations representative of a change in the input gradation to the classifying tank likely to take the constituency of the controlled product out of tolerance or to cause excessive discharge to the uncontrolled product.

BRIEF DESCRIPTION OF THE DRAWINGS

FIG. 1 is a simplified sectional plan view of one form of water scalping tank with which an input monitoring system constructed in accordance with the present invention may be utilized, taken approximately along line 1—1 in FIG. 2;

FIG. 2 is a simplified sectional elevation view of a water scalping tank taken approximately as indicated by line 2—2 in FIG. 1;

FIG. 3 is a transverse sectional elevational view of the water scalping tank taken approximately as indicated by line 3—3 in FIG. 1;

FIG. 4 is a transverse sectional view, similar to FIG. 3, illustrating a different discharge valve arrangement that may be utilized at each classification station of the tank;

DESCRIPTION OF THE PREFERRED EMBODIMENT

Figure 5:
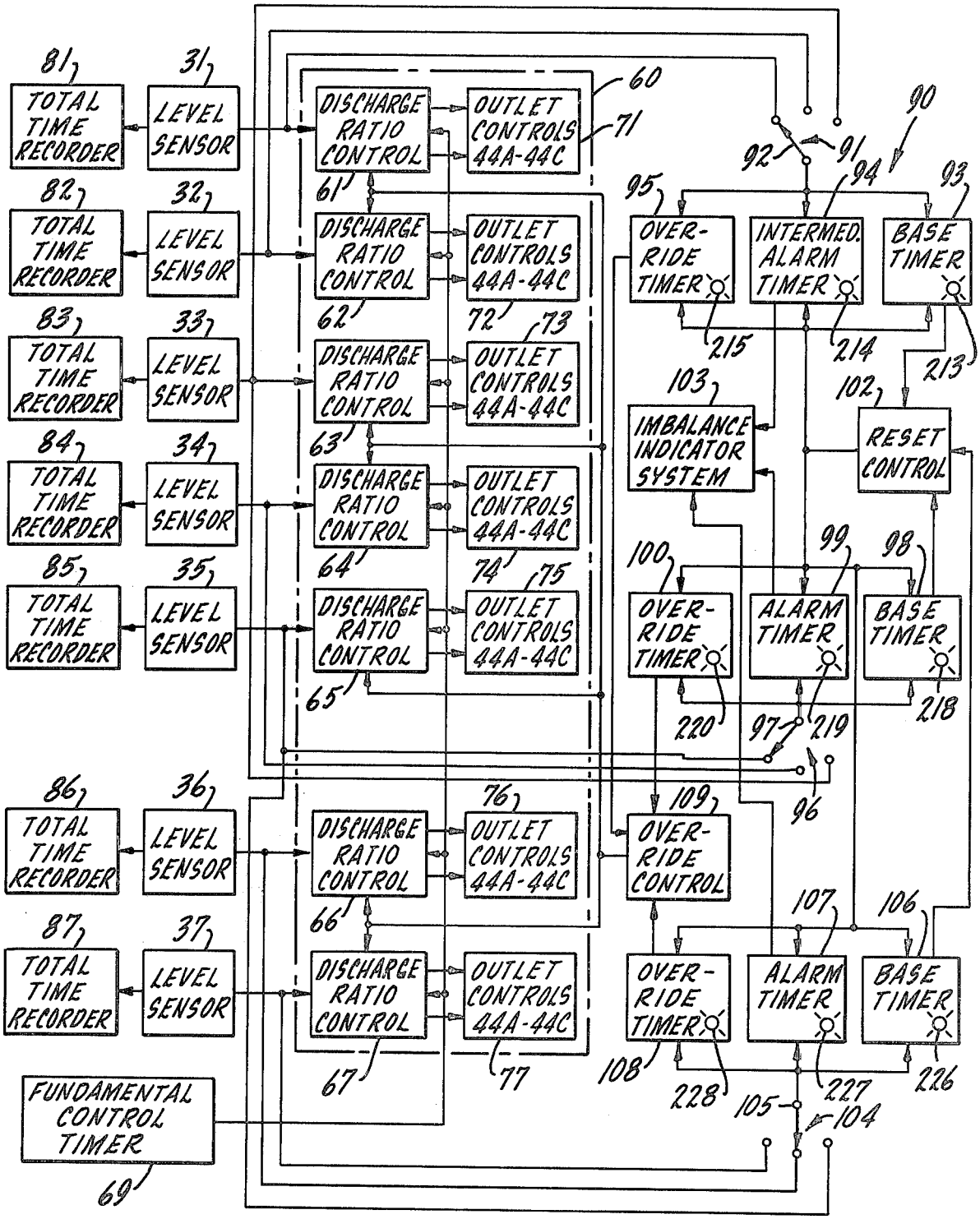
FIG. 5 is a block diagram of an input monitoring control system constructed in accordance with one embodiment of the present invention, applicable to a tank like that of FIGS. 1-3.

FIGS. 1, 2 and 3 illustrate, in simplified form, one form of water scalping sand classifying and reblending tank in which an input monitoring system constructed in accordance with the present invention may be incorporated. The scalping tank 10 uses the same basic construction as described in Keeney U.S. Pat. No. 3,114,179 and Cochran U.S. Pat. No. 3,160,321; it includes an input or coarse sand section 11 and an overflow or fine sand section 12. A feed box 13 is mounted on the end of input section 11; an input conduit 14 is connected to the feed box and an opening 15 leads from the feed box into tank section 11. Scalping tank 10 may also have an auxiliary water inlet 16, preferably located in the input section 11 of the tank as shown in FIG. 2.

Tank 10 has seven classification stations 21 through 27, displaced from each other along the bottom of the tank from the inlet end 11 of the tank to the overflow end 12. At the overflow end of the tank, there is an overflow conduit 28 for removing excess water from the tank.

All of the sand classification stations 21-27 are essentially similar in construction. A typical classification station 21, as shown in FIG. 3, includes a level sensor 31 for sensing the presence of a sufficient accumulation of sand to allow discharge from the classification station at a relatively constant rate for at least a minimum time interval entailed in opening and closing a discharge valve. Sensor 31 may be of conventional construction, comprising a sensing paddle 52 mounted on the lower end of a shaft 53 that projects vertically through the section of the tank in which station 21 is located. Shaft 53 extends through a guard 55 and is connected to a stall motor 54 that continuously drives the shaft. Motor 54 is electrically or mechanically connected to a sensing switch (not shown) actuated whenever there is a sufficient accumulation of sand or other granular material 56 to prevent continuing rotation of sensing paddle 52 and thus stall the motor 54. In this manner, the level sensor 31 develops an electrical signal, referred to herein as a discharge signal, whenever the accumulated material 56 is adequate to allow discharge of sand from classification station 21; whenever the sand supply 56 is depleted to a level at which paddle 52 can resume rotation, the discharge signal is terminated.

Each of the other classification stations 22-27 is provided with a level sensor like the level sensor 31 for station 21. In FIG. 2, these level sensors 32-37 are generally illustrated at each station.

The typical classification station 21 (FIG. 3) includes sand discharge means comprising three individual outlet valves 41A, 41B, and 41C in the bottom of tank 10. Valve 41A comprises a valve closure member 42A connected to an operating rod 43A that extends upwardly through the tank and is connected to a solenoid-operated hydraulic valve actuator 44A. Similarly, valve 41B comprises a valve closure member 42B connected to an operating rod 43B that is in turn connected to a valve actuator 44B. For outlet valve 41C, the principal components are a closure member 42C, an actuator 44C, and an operating rod 43C which connects the closure member to the actuator. Valves 41A-41C are individually connected to three outlet conduits 45A, 45B, and 45C, respectively.

Reblending of sand from tank 10 takes place in two controlled product reblending flumes 46A and 46B and in an auxiliary flume 46C for an uncontrolled residue. As shown in FIGS. 1 and 3, flume 46A is aligned with the discharge valve 41A at station 21 and with a similarly situated outlet valve at each of the other classification stations 22-27. Similarly, flume 46B is aligned with valve 41B and with its own individual outlet valve at each classification station. Residual flume 46C is aligned with the central outlet valve at each classification station of the tank. Individual outlets 47A, 47B, and 47C are provided for the reblending flumes 46A, 46B, and 46C respectively (FIGS. 2 and 3).

In operation, a slurry of sand and water is fed into feed box 13 through conduit 14 and flows into tank 10 through opening 15. Simultaneously, additional water may be supplied to the tank through conduit 16. As the slurry flows out of opening 15, the heavier particles settle most rapidly toward the bottom of the tank. Finer particles settle out more slowly. In this manner, sand accumulates on the bottom of the tank, the largest sand particles accumulating at the initial classification stations 21 and 22 and the finest sand settling out at the final classification station 27. The actual number of classification stations in the tank may vary, depending on the length and capacity of the tank; in most commercial installations, the number of classification stations is between six and twelve. With the flow of sand and water properly balanced, as by adjustment of the water input through conduit 16, virtually all of the sand settles to the bottom of the tank and the overflow of water into outlet conduit 28 is essentially free of sand.

When scalping tank 10 is in operation all of the sensor motors, such as motor 54 of sensor 31 (FIG. 3), are energized. These motors rotate the sensor paddles relatively freely in the water. With particular reference to classification station 21 (FIG. 3), the sand accumulation 56 eventually reaches a level at which it interferes with rotation of the sensing paddle 52. When this occurs, motor 54 stalls, actuating a sensing switch or other signal device connected to the motor and causing sensor 31 to develop a discharge signal. This discharge signal operates one or more of the valve actuators 44A–44C, opening at least one of the outlet valves 41A–41C. The resulting discharge, into one or more of the flumes 46A–46C, reduces the level of sand at station 21 and eventually frees paddle 52 for continuing rotation. As soon as paddle 52 resumes rotation, the discharge signal from sensor 31 is interrupted and actuators 44A–44C operate to close all of the discharge valves 41A–41C so that additional sand can accumulate at station 21. This process continues throughout the operation of scalping tank 10, at each of the classification stations 21–27, with each station controlled by its level sensor 31–37.

FIG. 4 illustrates a single classification station 121 for a water scalping sand classifying and reblending tank 110 that is generally similar to tank 10 but utilizes a different mechanical valve arrangement for discharge to the controlled specification product flumes 46A and 46B and the uncontrolled residual product flume 46C. Thus, station 121, which is typical of all stations for tank 110, includes a sand level sensor 31 comprising a sensing paddle 52 mounted on a shaft 53 driven by a stall motor 54. As in tank 10, the flumes 46A–46C are provided with outlets 47A–47C.

Station 121 of tank 110 includes an outlet valve 141 including a casing 143 and an internal valve closure member 142. The valve closure member 142 is actuated between open/closed conditions by compressed air introduced into the interior of casing 143. Valve 141 is connected to a solenoid-operated outlet actuator valve 144C, which is in turn connected to a compressor or other compressed air supply 111. The outlet side of valve 141 is connected to a flexible hose 145 that can be positioned over any of the three flumes 46A–46C.

Station 121 of tank 110 (FIG. 4) further comprises an air-actuated positioning device 112 connected to hose 145 by suitable means such as a ring deflector member 113. Positioning device 112 is connected to a first product diversion actuator valve 144A and to a similar second product diversion actuator valve 144B; valves 144A and 144B are both connected to air supply 111. When valve 144A is opened, device 112 drives hose 145 to a position over flume 46A to discharge sand to a first controlled specification product, referred to herein as Product A. Opening of valve 144B causes device 112 to position hose 145 over flume 46B, supplying sand to a second specification product, Product B. With neither actuator valve open, hose 145 is positioned, as shown, over the residual flume 46C.

Except for the outlet valve construction and the apparatus employed to divert the discharge to the different flumes 46A–46C, at each classification station, tank 110 is essentially similar to tank 10. Accordingly, operation of tank 110 need not be described in detail. Tank 110 includes a series of classification stations, usually six to twelve stations depending upon the length of the tank. A tank affording an outlet construction like that of tank 110 is described in Archer U.S. Pat. No. 3,467,281.

FIG. 5 illustrates a control system 60 for classifying tank 10 (or tank 110). In control system 60, the level sensor 31 for classification station 21 is electrically connected to a discharge ratio control 61 that actuates a station outlet control unit 71. For tank 10, unit 71 comprises the three valve actuators 44A–44C (FIG. 3). Similarly, each of the level sensors 32–37 for the remaining stations 21–27 of the tank are individually connected to discharge ratio control units 62–67. Each of the ratio control units 62–67 is connected to and actuates one of the outlet control units 72–77, which are individually associated with the remaining outlet stations of the tank. All of the discharge ratio controls 61–67 are connected to a fundamental control timer 69. The basic tank control system 60 of FIG. 5 corresponds to the control system described in detail in Keeney U.S. Pat. No. 3,114,479.

Each of the level sensors 31–37 is also individually connected to one of a series of total discharge time recorders 81–87. Recorder 81 maintains a cumulative record of the total time that any of the discharge valves 41A–41C of classification station 21 has been opened. Similarly, the other recorders 82–87 record the total discharge times for the other classification stations 22–27 of the tank.

Level sensor 31 is further connected to one of three input terminals for a selector switch 91 that is incorporated in an input monitoring system 90 constituting one embodiment of the present invention. Level sensors 32 and 33 are connected to the remaining input terminals of selector switch 91. The output terminal 92 of selector 91 is connected to three timers 93,94 and 95 which collectively define a first discharge monitoring means employed to measure the cumulative total discharge from a key classification station at the coarse end of the tank. The particular station utilized as the key station is determined by selector switch 91. FIG. 5 shows switch 91 set for connection to level sensor 31, so that station 21 is the key station; switch 91 can also be set to select station 22 or station 23.

Timer 93 is a base or minimum interval timer, set to time out after a predetermined minimum (base) period. Timer 94 is an intermediate timer, similar to timer 93 but set for a somewhat longer time interval. Timer 95, on the other hand, is an override (maximum) timer that is preset to time out after an interval even longer than that for timer 94.

Each of the timers 93–95 may be of conventional construction and may comprise any electrically actuated timing mechanism that produces one or more output signals, as by opening or closing one or more sets of relay contacts, upon measurement of a given cumulative time interval. Because the flow from each classification station is relatively constant whenever any one of the outlet valves is open, the time measurements made by timers 93–95 are effectively representative of volumes of sand discharged from the key classification station selected by switch 91.

The first (coarse) discharge monitoring means comprising timers 93–95 and selector switch 91 is duplicated by three timers 98, 99 and 100 and a second selector switch 96, constituting a medium discharge monitoring means. The three input terminals to selector switch 96 are individually electrically connected to level sensors 33, 34 and 35, respectively. The output terminal 97 of switch 96 is connected to each of the three timers 98,99 and 100. Timer 98 is a minimum (base) timer. Timer 99 is an intermediate timer, set for a time interval somewhat longer than base timer 98. Timer 100 is a maximum (override) timer, set to operate after a cumulative time interval longer than the setting of intermediate timer 99.

Monitoring system 90 further comprises a third (fine) discharge monitoring means which includes a selector switch 104, a base timer 106, an intermediate timer 107, and an override timer 108. The three input terminals to selector switch 104 are individually connected to level sensors 35, 36 and 37, respectively. The output terminal 105 of switch 104 is connected to each of the three timers 106–108, which are set for progressively longer time intervals, just as in the other groups of monitoring timers.

Each of the three base timers 93, 98 and 106 has an output electrically connected to a reset control 102. Control 102, in turn, is electrically connected to the reset coils or other reset mechanisms of all of the monitoring timers 93–95, 98–100, and 106–108. The three intermediate timers 94, 99 and 107 all have outputs electrically connected to an alarm indicator system 103 that is employed to inform the tank operator with respect to the current operating conditions for the tank input.

The three override timers 95, 101 and 108, are all electrically connected to an override control circuit 109. The override control 109 is connected back to the controls for each of the operating stations of the tank. More specifically, in the illustrated system the override control circuit 109 is connected to each of the discharge ratio controls 61–67 for tank 10 (or tank 110).

Whenever level sensor 31 detects a sufficient accumulation of sand to permit discharge from classification station 21, an output signal is applied to ratio control 61. Control 61 actuates the outlet controls 71 to open valves 41A–41C in accordance with a preset duty cycle and thus controls the ratio of discharge from classification station 21 into the three output flumes 46A, 46B and 46C of the tank (FIGS. 1–3). Ordinarily, most of the discharge will be directed to the two controlled product flumes 46A and 46B. Indeed, it is quite usual for all discharge from a given classification station to be directed to the two controlled product flumes 46A and 46B with no discharge to the residual product flume 46C except under unusual conditions such as described below. In the same manner, the output signals from level sensors 32–37 actuate ratio controls 62–67, which in turn operate the outlet controls 72–77 for the other classification stations of the tank.

Recorders 81–87 each record the total time of discharge for one particular classification station of the tank. They provide a long-term record for use in analysis by the system operator. They perform no direct control function.

For the coarse discharge monitoring means comprising timers 93–95, as noted above, selector switch 91 is set to select one of the three level sensors 31–33 to establish one of the stations 21–23 as a key classification station. With selector switch 91 in the position shown, station 21 is selected. Accordingly, each time level sensor 31 is actuated and discharge from station 21 is initiated, an electrical signal is supplied to each of the three timers 93–95; that signal is maintained until the level of sand falls below that necessary for discharge at station 21. When this occurs, the input signal to timers 93–95 from sensor 31 terminates until sufficient sand accumulates to again initiate discharge.

Thus, each of the timers 93–95 measures the cumulative total discharge at the key classification station for coarse sand, station 21.

The second (medium) discharge monitoring means comprising timers 98, 99 and 100 functions in the same manner. As shown, selector 96 is set to select level sensor 35 of tank station 25 for the input to each of the three timers. All three of the timers measure the cumulative total time of discharge, and hence the total volume of discharge, at a second key classification station for medium size sand, in this instance station 25.

The third (fine) discharge monitoring means comprising the timers 106–108 is shown set, through selector switch 104, to monitor the discharge from classification station 26, the output signal from level sensor 36 being applied to each of the timers. In each of the three discharge monitoring means, all of the timers measure the cumulative discharge to all products.

To understand the overall operation of the input monitoring system 90 of the invention, specific time settings for the timers of the three discharge monitoring means incorporated in the system may be assumed. For a given operation, these may e as follows:

TABLE I

TIMER SETTING EXAMPLE

| Particle Size | Base No. | Timer Time (Hrs.) | Inter. No. | Timer Time (Hrs.) | Over. No. | Timer Time (Hrs.) |
|---|---|---|---|---|---|---|
| Coarse | 93 | 2 | 94 | 2.5 | 95 | 2.75 |
| Medium | 98 | 1.5 | 99 | 1.75 | 100 | 2 |
| Fine | 106 | 1 | 107 | 1.17 | 108 | 1.33 |

For the time settings set forth in Table I, in a particular instance, timers 93–95 for the coarse discharge monitoring means may record a total of more than 2 hours but less than 2½ hrs. and the timers 98–100 of the medium discharge monitoring means may record totals of more than 1½ hours but less than 1¾ hrs, during a time span in which the three timers 106–108 of the fine sand monitoring means record a total cumulative time of just one hour. Under these circumstances, when the timers 106–108 reach the one hour total, base timer 106 supplies a reset signal to reset control 102. The reset control is already receiving reset signals from base timers 93 and 98, which have timed out previously. Accordingly, the reset control 102 is actuated and produces a reset signal that resets all of the timers. For these conditions, no alarm is generated by system 103, although some visual indication of the actual operating conditions may be given by the alarm indicator system.

With a change in input, during a subsequent interval, the coarse monitor timers 93–95 may reach a cumulative total discharge time of 2 hours after the medium timers 98–100 have reached a cumulative total of more than 1½ hours and less than 1¾ hours, and after the fine monitoring timers 106–108 have recorded a total cumulative time of more than one hour but less than 1 hour 10 minutes. Under these conditions, as in the first operating example, all of the timers are reset by control 102 and the system continues in operation with no alarm from system 103. The same result is reached if the medium monitoring timers 98–100 reach the base setting of 1½ hours for timer 98 after the base timers 93 and 106 have timed out but before the alarm timers 94 and 107 time out.

It is thus seen that whenever the three base timers 93, 98 and 106 all time out before any of the three intermediate timers 94, 99 and 107, all of the timers in monitoring system 60 are reset and no substantial alarm is given. However, and as explained more fully in connection with the specific controls described below, indicator lamps or the like may be incorporated into monitor system 90 to keep the tank operator continuously informed as to even limited variations in the gradation of the sand input to the tank.

If the input to the tank changes so that it includes greater quantities of coarse sand, the alarm timer 94 for the coarse sand discharge monitoring means may accumulate a total of 2½ hours recorded before either of the medium and fine base timers 98 and 106 time out. Whenever this occurs an alarm, visual or audible, or both, is actuated by alarm system 103. If the medium and fine base timers 98 and 106 then time out before the override timer 95 of the coarse monitoring means reaches a cumulative total of 2¾ hours, nothing further occurs; the system resets and operation continues. However, if the coarse override timer 95 times out before the medium and fine base timers 98 and 106 time out, then override timer 108 applies an actuating signal to control 109.

Control 109, in turn, applies an override signal to each of the discharge ratio control units 61–67 in the main control 60 for the tank. From that point until timers 98 and 106 time out, all further discharge from the tank is directed to the residual (uncontrolled) flume 46C. In this manner, monitoring system 60 avoids the discharge of excessive quantities of coarse sand to the controlled or specification products being formed in flumes 46A and 46B. As soon as base timers 98 and 106 time out, all of the monitoring system timers are reset and normal operation is resumed.

Under other circumstances, still using the timer setting example of Table I, the total cumulative discharge time recorded by medium timers 98–100 may exceed the 1¾ hour setting for alarm timer 99 before either of the coarse and fine base timers 93 and 96 have timed out. When this occurs, alarm timer 99 supplies an actuating signal to alarm indicator system 103, initiating operation of a visual or audible alarm, or both, to indicate to the tank operator that the input to the tank includes excessive sand in the medium sizes and that an override operation may be imminent.

For these circumstances, if timers 93 and 106 time out before the medium override timer 100 records a total of 2 hours cumulative discharge, the system continues to operate normally. On the other hand, if the medium override timer 100 times out before either of the coarse and fine base timers 93 and 106, then timer 100 supplies an actuating signal to control 109, and control 109 in turn applies an override signal to each of the output ratio controls 61–67 to divert all further discharge to the uncontrolled residual flume 46C until such time as both of the base timers 93 and 106 have accumulated the requisite minimum discharge times.

It may also happen that, with a change of input to tank 10 (or tank 110), the fine sand intermediate timer 107 may accumulate a total time of 1 hour 10 minutes before either of the coarse and fine base timers 93 and 106 has reached its predetermined setting (see Table I). When this happens, timer 107 actuates alarm indicator system 103 to energize an appropriate alarm and inform the tank operator that the input to the tank is running too heavy in fine sand and that diversion to the uncontrolled product flume 46C may soon occur. If the coarse and medium base timers 93 and 98 time out before the fine override timer 108 times out, normal system operation resumes. On the other hand, if timer 108 reaches its preset cumulative level of one hour 20 minutes when either of the timers 93 or 98 has not yet timed out, then timer 108 supplies an actuating signal to control 109 and the control applies an override signal to the ratio control units 61–67 to divert tank discharge to the residual product flume 46C until all of the base timers time out and the monitoring system is reset.

Figure 6:
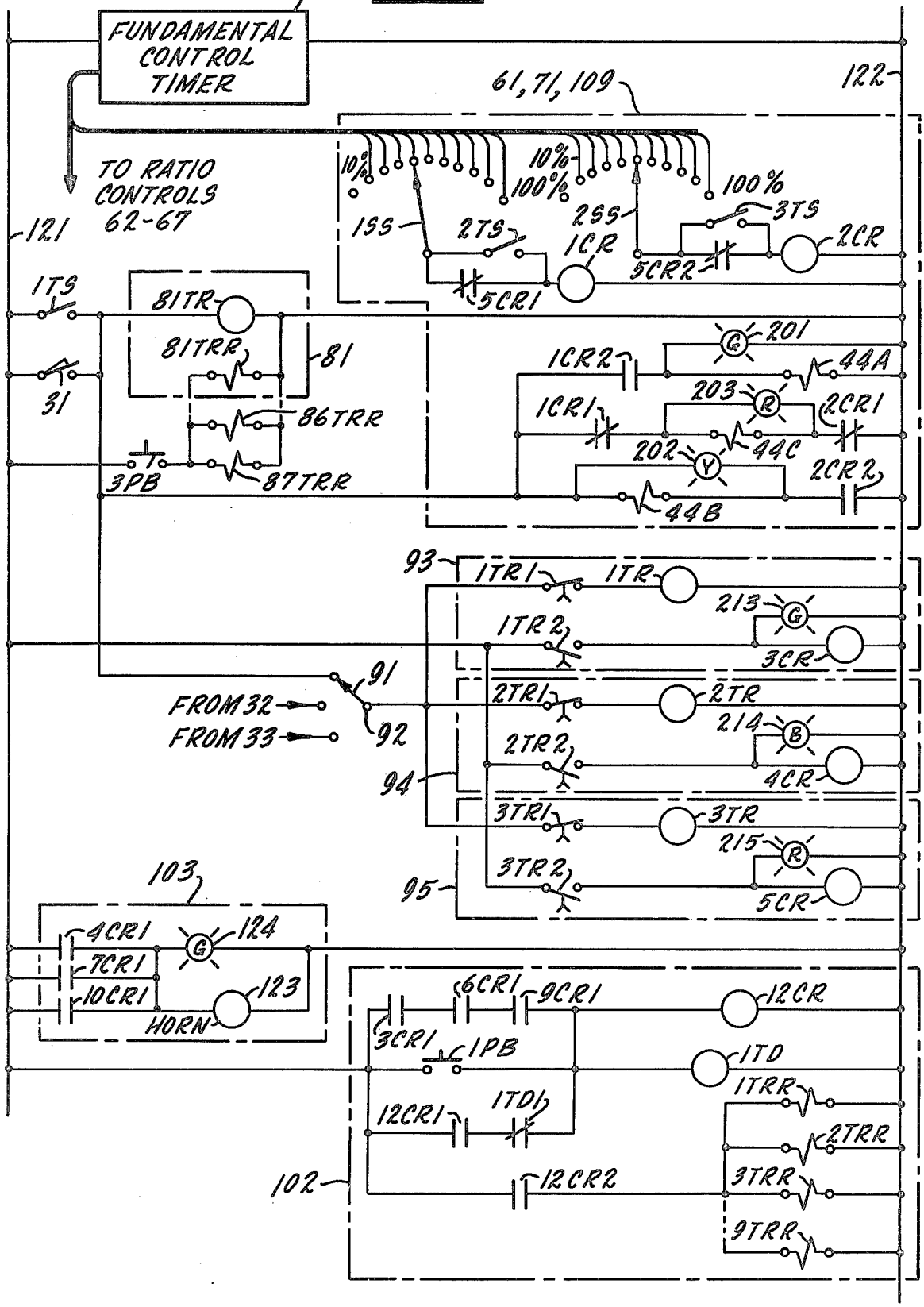
FIG. 6 is a schematic diagram of one form of circuit that may be employed for the control system of FIG. 5.

FIG. 6 affords a schematic circuit diagram for one form in which the control system of FIG. 5 may be implemented. The system illustrated in FIG. 6 includes two power lines 121 and 122 connected to a suitable AC power supply (not shown). The fundamental control timer 69 is connected to supply lines 121 and 122. The master time control unit 69 is connected to the input terminals of two selector switches 1SS and 2SS. The master timer is a continuously operable duty-cycle selector that connects each of its output terminals to supply line 121 for varying time intervals, over a given duty cycle. Timer 69 may correspond in all pertinent respects to the master timer 101 of Keeney U.S. Pat. No. 3,114,479, and hence requires no further structural or operational description herein.

The output terminal of selector switch 1SS is connected to a control relay operating coil 1CR through the parallel combination of a manually operable toggle switch 2TS and a set of normally closed relay contacts 5CR1. Coil 1CR is also connected to power line 122. Similarly, the output terminal of selector switch 2SS is connected through a pair of normally closed relay contacts 5CR2 and a switch 3TS to a relay operating coil 2CR, coil 2CR being returned to power line 122.

In the circuit of FIG. 6, selector switches 1SS and 2SS and control relays 1CR and 2CR are a part of the output ratio control 61 for the first classification station 21 of the classifying tank (see FIGS. 1–3 and 5). The level sensor 31 for classification station 21 is illustrated, in FIG. 6, as a switch having one terminal connected to power line 121. A toggle switch 1TS is connected in parallel with level sensor 31. The other terminal of sensor switch 31 is connected to the operating solenoid for valve actuator 44A (see FIG. 3) through a pair of normally open relay contacts 1CR2. Solenoid 44A is also connected to the other power line 122. Sensor switch 31 is also connected to a pair of normally closed relay contacts 1CR1. The solenoid for valve actuator 44C is connected between contacts 1CR1 and a second set of normally closed contacts 2CR1, contacts 2CR1 being returned to power line 122. In addition, level sensor 31 is connected to the valve actuator solenoid 44B, and solenoid 44B is returned to power line 122 through a pair of normally open relay contacts 2CR2.

The remaining ratio control circuits 62–67 and associated outlet controls 72–77 (FIG. 5) are not shown in FIG. 6, since each is a substantial duplicate of circuit 61,71. Thus, each of the ratio control units 62–67 includes a pair of selector switches, like switches 1SS and 2SS, connected to the master timer control 69, and two control relays corresponding to relays 1CR and 2CR. Control units 62–67 are each connected to the level sensor and to the valve actuator solenoids for their respective classification stations in the same manner as described above for ratio control 61.

The total time recorder 81, in the circuit of FIG. 6, comprises a timer coil 81TR connected between the first station level sensor switch 31 and power line 122. The time recorder 81 includes a reset solenoid 81TRR having one terminal connected to power line 121 through a switch 3PB and having its other terminal connected to the power line 122. The reset solenoids 82TRR–87TRR for the other total time recorders 82–87 (FIG. 5) are all connected in parallel with solenoid 81TRR so that all of the time recorders are reset simultaneously.

In the circuit of FIG. 6, the coarse sand key classification station selector switch 91 is shown as having one of its input terminals connected to the first station level sensor switch 31. The other input terminals for switch 91 are similarly connected to the level sensors 32 and 33 for the second and third discharge stations of the tank.

The output terminal 92 of selector switch 91 is connected to the common terminal of a set of normally closed timer contacts 1TR1, in turn connected to a timer operating coil 1TR which is returned to power line 122. A set of normally open timer contacts 1TR2 are connected from power line 121 to a control relay operating coil 3CR which is returned to power line 122. Timer 1TR and control relay 3CR together constitute the coarse sand base or minimum timer 93 (see FIG. 5).

The output terminal 92 of selector switch 91 is also connected to the common terminal of a set of normally closed timer contacts 2TR1. Contacts 2TR1 are connected to a timer operating coil 2TR that is returned to power line 122. A pair of normally open timer contacts 2TR2 are connected between power line 121 and a relay operating coil 4CR that is returned to power line 122. Timer 2TR and control relay 4CR together form the coarse sand intermediate (alarm) timer 94.

In the circuit of FIG. 6, the coarse sand override (maximum) timer 95 comprises a timer coil 3TR and a control relay 5CR. The operating circuit for the timer coil extends from selector switch terminal 92 through the normally closed timer relay contacts 3TR1 and then to power line 122. For coil 5CR, the circuit goes from line 121 through the normally open contacts 3TR2 and the coil to line 122, all as described above for the other timers in the coarse sand discharge monitoring means.

The specific components and connections for the medium discharge monitoring means comprising selector switch 96 and timers 98–100, and for the fine discharge monitoring means comprising selector switch 104 and timers 106–108 are not illustrated in FIG. 6 because they are essentially similar to those described above for the coarse discharge monitoring means, selector switch 91 and timers 93–95.

In the circuit of FIG. 6 the reset control 102 comprises a control relay having an operating coil 12CR that is connected across the power lines 121 and 122 in a circuit that includes, in series, three sets of normally open relay contacts 3CR1, 6CR1 and 9CR1. The contacts 3CR1 are a part of the control relay actuated by coil 3CR in base timer 93; contacts 6CR1 and 9CR1 are from corresponding relays in the other base timers 98 and 106 (FIG. 5). A manually operable switch 1PB is connected in parallel with the relay contacts 3CR1, 6CR1, and 9CR1. A holding circuit for coil 12CR is provided by a pair of normally open relay contacts 12CR1 connected in series with a pair of normally closed time delay relay contacts 1TD1. The operating coil 1TD of the time delay relay is connected in parallel with coil 12CR.

A second pair of normally open relay contacts 12CR2 are connected in an energizing circuit for a group of timer reset solenoids 1TRR, 2TRR, 3TRR . . . 9TRR. Solenoid 1TRR is employed to reset device 1TR in the coarse product base timer 93. Solenoid 2TRR resets the timing device 2TR in intermediate timer 94 for the coarse end of the tank. Solenoid 3TRR resets the timing relay 3TR in the override timer 95 for the coarse end of the tank. The remaining reset solenoids connected to the energizing circuit provided by contacts 12CR2 are utilized in conjunction with the other timers 98–100 and 106–108 of monitoring system 90 (FIG. 5).

A simple form of imbalance alarm or indicator system 103 is shown in FIG. 6. It comprises a horn 123 and an indicator lamp 124, both energizable through any one of three parallel circuits that include the normally open relay contacts 4CR1, 7CR1, and 10CR1, respectively. Contacts 4CR1 are a part of the relay 4CR having its operating coil incorporated in the intermediate alarm timer 94 for the coarse end of the tank. The contacts 7CR1 and 10CR1 are from similar relays in the alarm timers 99 and 107 for the medium and fine discharge stations of the tank (see FIG. 5).

The foregoing description covers exemplary circuits for all of the control units of FIG. 5 as shown in FIG. 6 with the exception of the override control 109. In FIG. 6, the override control is illustrated as an integral part of the discharge ratio control 61, constituting the normally closed relay contacts 5CR1 and 5CR2 in that circuit. This circuit arrangement for the override control is typical for a station used only as a key station for one material gradation, such as stations 21, 22, 24, 26 and 27. For overlap stations that may be monitored as key stations for different gradations, such as station 23 (coarse or medium) or station 25 (medium or fine), depending upon the settings of the selector switches 91, 96 and 104, there may be two sets of contacts in series in the energizing circuit for each of the control relays corresponding to control relays 1CR and 2CR in FIG. 6.

In considering the operation of the circuits shown in FIG. 6, it must first be recalled that the fundamental control timer 69 connects the terminals of the two selector switches 1SS and 2SS in ratio control 61 to power line 121 for predetermined time intervals of varying cumulative length. In FIG. 6, switch 1SS is set to the 40% level and switch 2SS is set to a level of 50%, leaving a time interval of 10% in each cycle of control 69 during which neither selector switch is electrically connected to power line 121. Of course, the other ratio controls 62–67 (FIG. 5) may be set to very different percentage levels, depending upon the requirements of the two specification products to be formed in flumes 46A and 46B.

During any time interval in which selector switch 1SS is connected to power line 121 through the fundamental control timer 69 (FIG. 6), control relay coil 1CR is energized, closing contacts 1CR2 and opening contacts 1CR1. Accordingly, when level sensor switch 31 closes, the solenoid 44A constituting the outlet actuator for valve 41A at the first discharge station of the tank is energized and coarse sand is discharged to flume 46A as a contribution to the first specification product. Each time this happens, a green indicator lamp 201 connected in parallel with solenoid 44A is also energized, indicating to the tank operator that a discharge to the A product is occurring.

At a different time, when selector switch 2SS is effectively connected to power line 121 through the fundamental control timer 69, as it is fifty percent of the time, the control relay coil 2CR is energized. Closing of level sensor switch 31 then energizes solenoid 44B, the actuator for valve 41B at the first discharge station of the tank, because contacts 2CR2 are closed. At the same time, contacts 2CR1 are open to preclude energization of solenoid 44C, with solenoid 44B energized, coarse sand is discharged from station 21 into the second specification product flume 46B. The operator is able to ascertain that this action is taking place by observing a yellow indicator lamp 202 connected in parallel with solenoid 44B.

For the conditions noted above, with switches 1SS and 2SS set for 40% and 50% respectively, there is a 10% time interval in the cycle of timer 69 during which neither of the two control relays 1CR and 2CR is energized. Whenever level sensor switch 31 closes during this 10% cycle interval, it is solenoid 44C that is energized, actuating valve 41C to discharge sand from station 21 to the residual product flume 46C. Once again, the operator is made aware that this operation is taking place by the energization of a red indicator lamp 203 that is connected in parallel with solenoid 44C. It will be recognized that the operation of discharge ratio control 61 of FIG. 6 thus corresponds to the operation of one of the individual station controls described in Keeney U.S. Pat. No. 3,114,479.

Each time level sensor switch 31 closes to initiate a discharge to one of the flumes from the first discharge station 21 of the tank, it completes an energizing circuit to each of the three timer relay coils 1TR–3TR through selector switch 91, assuming that switch is set as shown in FIG. 6. Accordingly, the three timers 93–95 each record, on a cumulative basis, the time of discharge from station 21, without regard to the product to which the discharge goes. This time measurement is closely related to discharge volume.

Because the timing relay 1TR in base timer 93 is set for a shorter time interval than the timing relays of intermediate timer 94 or override timer 95, timer 93 is the first to time out. This action indicates that the base period selected for discharge of coarse sand from station 21 to the specification products has been completed. When this occurs, contacts 1TR1 open to preclude further energization of the base timer relay 1TR. At the same time, contacts 1TR2 close, energizing control relay coil 3CR. A green indicator lamp 213 connected in parallel with coil 3CR is also energized, indicating to the operator that the base period has been completed for the coarse sand key station. Moreover, contacts 3CR1 in reset control 102 close.

If the input to the tank corresponds reasonably closely to the overall requirements for the specification products, the base period timers 98 and 106 (FIG. 5) will also time out before any of the intermediate or override timers of the input monitoring system. As a consequence, contacts 6CR1 and 9CR1 in reset circuit 102, which are contacts for relays corresponding to relay 3CR that are incorporated in the other base timers 98 and 106, close to complete an energizing circuit for the control relay coil 12CR and the time delay relay coil 1TD. The energization of coil 12CR closes relay contacts 12CR1 and 12CR2. With contacts 12CR2 closed, the reset solenoids 1TRR through 9TRR are all energized, resetting all of the timing relays in the timers 93–95, 98–100, and 106–108. Contacts 12CR1 maintain a holding circuit for coil 12CR to assure completion of the reset operation even though one or more of the contact pairs 3CR1, 6CR1 and 9CR1 may open before completion of all reset operations. After a given time delay interval, selected to be long enough to assure complete reset for all of the timers, the time delay relay contacts 1TD open, de-energizing both of the coils 12CR and 1TD and restoring the reset control circuit 102 to its original condition. This begins a new monitoring cycle.

If it is now assumed that the input to the tank changes to produce an excess accumulation of coarse sand at station 21, as compared with the normal requirements for the specification products, the timing relay 2TR in the intermediate timer 94 times out before the base timers 98 and 106 for the medium and fine key stations of the tank have timed out. Of course, when this occurs the base timer 93 for the coarse end of the tank has already timed out. Contacts 2TR1 now open to preclude further energization of timing relay coil 2TR; contacts 2TR2 close to energize control relay 4CR and a blue indicator lamp 214 that is connected in parallel with coil 4CR.

The energization of coil 4CR closes contacts 4CR1 in alarm indicator system 103. This completes an energizing circuit for horn 123 that alerts the operator that the input to the tank is changed in some potentially undesirable manner. The indicator lamp 124 is also energized through contacts 4CR1 for the same purpose. To determine which end of the tank is receiving excess input, the operator notes the energization of lamp 214. Thereafter, assuming that the other base timers of the monitoring system time out before override timer 95 has timed out, all timers are reset as described above. Of course, it is possible that two of the imbalance alarm timers such as timer 94 may time out before reset occurs. If this happens, the operator sees that two of the intermediate timer indicator lamps are lit and thus becomes aware that the imbalance in input constitutes a deficiency for that portion of the tank where the intermediate timer has not timed out.

If one of the intermediate timers such as timer 94 times out prior to reset of the monitoring system only on an occasional basis, there is no necessity to revise the control settings for the two specification products or to change the tank input. On the other hand, if this condition occurs frequently, it indicates to the operator that the tank is not functioning efficiently. That is, the tank is not making the best use of the changed input in formation of the specification products. On this basis, and depending upon the quantity requirements for the specification products and on the availability of control over the input to the tank, the operator may elect to modify the specification product settings or may change the tank input.

If a gross increase in the input of coarse material to the tank occurs, the timing relay 3TR in override timer 95 may time out before reset of the monitoring system occurs. In this circumstance, contacts 3TR1 open to preclude further energization of coil 3TR. Contacts 3TR2 close to energize control relay coil 5CR and the red indicator lamp 215 connected in parallel with that coil. The operator already knows that there has been a change in input to the tank, because the intermediate alarm timer 94 has timed out previously to actuate horn 123 as described above. The operator is able to identify timer 95 as the override timer which has timed out, based on the indicator lamp 215. In this instance, however, the change is sufficient so that the specification products may be thrown out of tolerance. This is prevented, for station 21, by the opening of contacts 5CR1 and 5CR2, which now preclude energization of either of the control relay coils 1CR and 2CR. Thus, from this point forward until the monitoring system is reset, all discharge from station 21 is directed to the residual product flume 46C because only solenoid 44C can be energized. Coil 5CR includes additional contacts incorporated in the ratio controls 62 and 63 for the other discharge stations at the coarse end of the tank, so that these stations are also diverted to the residual product flume to preclude deposit of excessive amounts of coarse sand in the two specification products.

A major deficiency at one end of the tank is also signalled to the operator through the override timers. Thus, if the coarse sand override timer 95 and the medium sand override timer 100 both time out before monitoring system 90 is reset, the indicator lamps for both of those timers are on and can be observed by the operator. On this basis, the operator is made aware that the major change in input actually constitutes a deficiency of fine sand rather than an excess of either medium or coarse sand.

Returning to FIG. 6, it is seen that each time the coarse sand level sensor switch 31 closes, timer relay 81TR in the total time recorder 81 is energized. Thus, recorder 81 continuously logs the total time of discharge from the first discharge station 21 of the tank. A corresponding function is performed by each of the other time recorders 81–87. This gives the operator a cumulative record, over a substantial period of time, of the gradation of the input to the tank. This long-term record affords data highly useful in allowing the operator to set up the ratio controls 61–67 for the most efficient use of the tank input in the production of the specification products. There is no automatic reset of the total time recorders 81–87. Whenever the operator desires to begin a new data accumulation period, as when the input source for the tank is changed, all of these timers are reset by actuation of switch 3PB to energize the reset solenoids 81TRR–87TRR. A similar manual reset is provided for the monitoring timers, by means of the manually actuated switch 1PB in reset circuit 102 (FIG. 6), making it possible to start the monitoring system 90 anew whenever desired.

In monitoring system 90, as described in conjunction with FIGS. 5 and 6, all of the discharge ratio control units 61–63 for the coarse end of the tank are provided with relay contacts actuated by the override control relay 5CR (FIG. 6). Consequently, whenever the key classification station for the coarse sand (determined by selector switch 91) exceeds the tolerance established by the override timer 95 associated with that station, the discharges from all coarse sand stations 21–23 are diverted to the residual product flume 46C. Sometimes, however, a general diversion of all coarse sand may not be desirable. For example, if station 23 has been selected as the coarse sand key classification station, and the input of the coarse sand accumulating there has gone out of tolerance as evidenced by the timing out of override timer 95, it may still be desirable to continue discharge into the specification product flumes 46A and 46B from station 21 until the monitoring system 90 is reset. Selective application of the override function is accomplished by shunting the override relay contacts. Thus, switches 2TS and 3TS can be closed, thereby eliminating the override operation for discharge station 21. Of course, a similar arrangement can be followed with respect to the ratio controls 62–67 for any of the other classification stations 22–27.

Another technique that may be adopted for selective application of override signals to the main tank control 70 (FIG. 5) is to employ just one override control relay instead of the three relays represented by relay 5CR (FIG. 6). In an arrangement of this kind the one override relay, actuated by timing out of any one of the three override timers 95, 100, and 108, provides a diversion action for all of the classification stations 21–27. Selectivity can still be provided with the shunt switches 2TS, 3TS, etc. in the ratio control circuits.

Of course, the specific implementation of monitoring system 90 illustrated in FIG. 6 can be varied to a substantial extent with respect to the hardware employed. For example, the three timers 93–95 may constitute a single mechanism driven by one motor coil (instead of coils 1TR-3TR), having three sets of settable contacts. By the same token, it is not essential that electromagnetic and electromechanical control devices be employed in the implementation of monitoring system 90. The logical functions of the control can be readily performed by solid state devices, at least as regards a considerable portion of the system. The substitution of solid state switching for the mechanical switching illustrated does not constitute a departure from the invention.

As shown in FIG. 5, the monitoring system timers 98, 99, 100, 106, 107 and 108 are provided with indicator lamps 218, 219, 220, 226, 227 and 228, respectively. Table II shows the imbalance conditions that can occur, in operation of the tank; for each condition given in Table II, the general indicator and alarm 103 is operational.

TABLE II

| | Lamps Lit | | | | | | | | |
|---|---|---|---|---|---|---|---|---|---|
| Condition | 213 | 214 | 215 | 218 | 219 | 220 | 226 | 227 | 228 |
| Excess coarse | x | x | | | | | | | |
| Excess medium | | | | x | x | | | | |
| Excess fine | | | | | | | x | x | |
| Deficit coarse | | | | x | x | | x | x | |
| Deficit medium | x | x | | | | | x | | |
| Deficit fine | x | x | | x | x | | | | |
| Gross excess, coarse | x | x | x | | | | | | |
| Gross excess, medium | | | | x | x | x | | | |
| Gross excess, fine | | | | | | | x | x | x |
| Gross deficit coarse | | | | x | x | x | x | x | |
| Gross deficit medium | x | x | x | | | | x | x | x |
| Gross deficit fine | x | x | x | x | x | x | | | |

Whenever any one of the override timers 95,100 and 108 times out, an undesirable input imbalance condition is indicated, sufficient to take the controlled products A and B out of tolerance or to cause excessive and wasteful discharge to the uncontrolled product C, depending on the particular reblend control used for the tank. By the same token, timing out of any of the alarm timers 94, 99 and 107 also indicates an undesirable input change, particularly if repeated. An imbalance detected by monitoring system 90 is not momentary in nature; only a variation in the ratio of cumulative discharges for the key stations which prevails over an extended period and which signifies a substantial input change is detected. For any of the conditions in Table II a tank operator is informed that a modification of the tank input may or should be effected to maintain economical operation.

A particularly interesting aspect of monitoring system 90, in relation to long-term control of tank operations, pertains to the information that can be derived directly from the operations of the monitor timer control relays (e.g. 3CR–5CR) or from the equivalent switching devices employed in a modified system. These control relays can be employed to derive outputs, indicative of the results of the monitoring operation, which may be fed directly to a computer to compile data regarding the frequency with which the individual base, alarm, and override timers for each key station time out over an extended period of time. If this information is correlated with the position of a dredge or with other changes in the source of material fed into the tank, an optimum pattern can be ascertained to maintain maximum output of the desired specification products and thereby minimize the discharge of material to the residual product, which is virtually always of considerably lower economic value.

In system 90, as illustrated in FIGS. 5 and 6, there are three stages of monitoring, applied to the coarse, medium, and the fine ends of the tank. In many situations, however, it is not essential to monitor this many classification stations. Instead, the medium monitoring means comprising selector switch 96 and timers 98–100 or the fine monitoring means 104–108 may be eliminated entirely. With this change, the monitoring operation is carried out only with respect to two selected key classification stations, one for the coarse end of the tank and one in the medium or fine part of the tank. For many applications, this coverage is adequate.

It will be recognized that monitoring system 90 does not control the basic reblending ratios for discharge of sand to products A–C; that function is performed by the main control 60. Although the invention has been described in conjunction with a reblending control 60 conforming to Keeney U.S. Pat. No. 3,114,479, it can also be applied to other controls, such as those of Cochran U.S. Pat. No. 3,160,321, Archer U.S. Pat. No. 3,467,281, McCauley U.S. Pat. No. 3,913,788. Monitoring system 90 gets its basic information from level sensors 31–37, and does not require inputs from the reblending control. Moreover, for a tank used in conjunction with a metering bin for the most coarse material, a common practice, the metering bin and its reblend control can be treated as constituting the first station of the tank.

Figure 7:
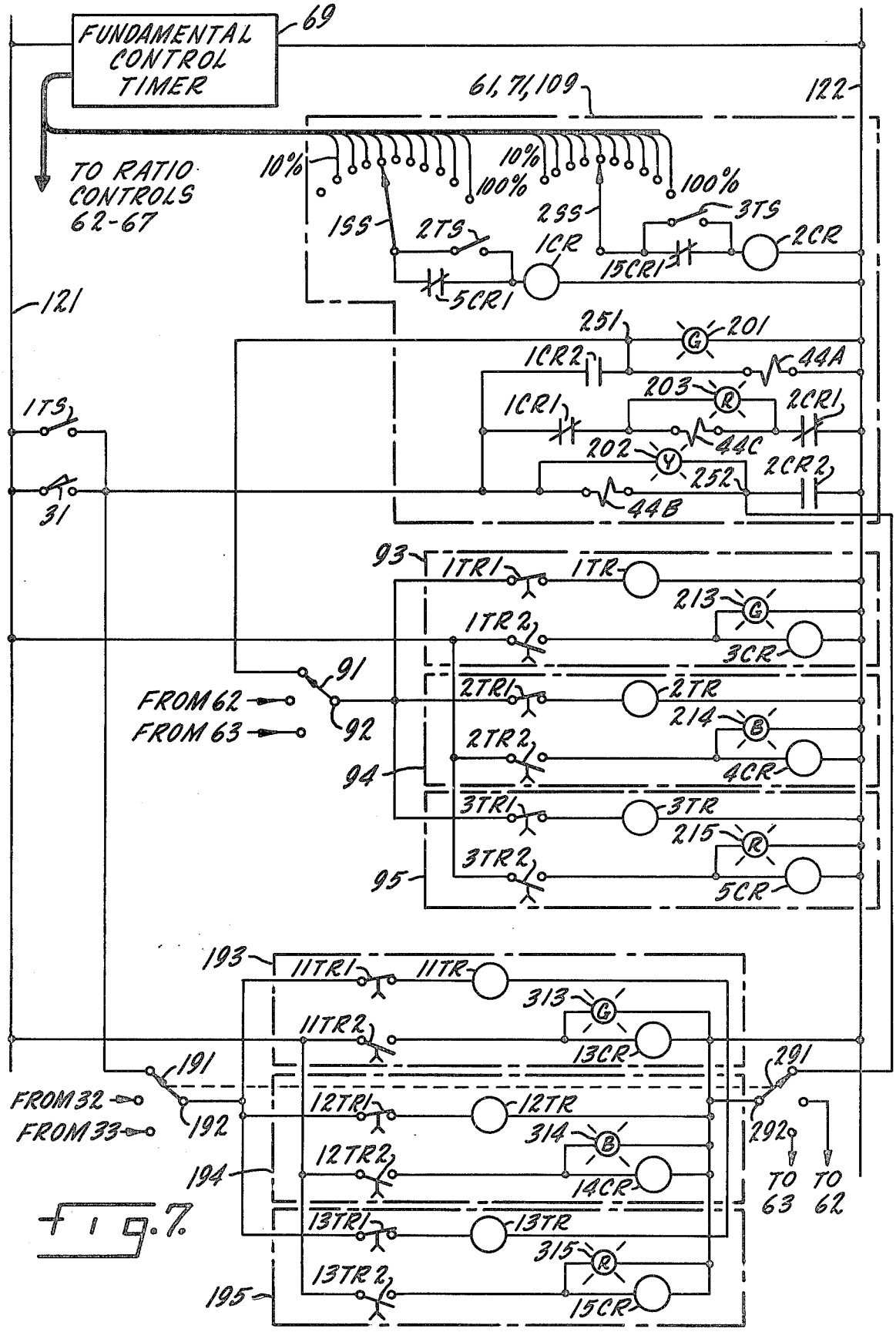
FIG. 7 is a partial circuit diagram, similar to FIG. 6, of another embodiment of the invention.

In some applications, the monitoring system of the present invention may be applied to the tank on an individual specification product basis. That is, a first monitoring system corresponding to system 90 (FIG. 5) may be employed to monitor the tank performance with respect to the discharge of key stations to the first control product flume 46A and a second monitoring system, essentially a duplicate of system 90, may be used to perform the same function for the second specification product flume 46B. In an arrangement of this kind, override control is performed separately for each controlled product and the discharge to residual flume 46C is not taken into account except through the total timer recorders 81–87, which remain unchanged. A circuit arrangement of this kind is shown in FIG. 7, encompassing much the same part of the total system as FIG. 6. In the circuit of FIG. 7, the ratio discharge control 61 and its connections to the fundamental control timer 69 remain essentially unchanged. The outlet control circuits 71 are also unchanged. The override control 109 is modified only to the extent that the normally closed relay contacts in series with coil 2CR are a set of contacts 15CR1 from a different relay, identified in the following description.

In the embodiment of FIG. 7, timers 93, 94 and 95 are of the same construction as in FIG. 6. In this instance, however, the input terminals to selector switch 91 are not connected directly to the level sensor switches 31–33. Instead, one input terminal of switch 91 is connected to a terminal 251 between relay contacts 1CR2 and solenoid 44A in control 61. Thus, timers 93, 94 and 95 in this embodiment of the monitoring system measure the cumulative time of discharge to the first controlled product only instead of to all products. The same kind of connection is made to the other discharge ratio controls 62 and 63, from switch 91, so that only discharge to the A product is measured by timers 93–95 regardless of which station 21–23 is selected as the key station for the coarse end of the tank.

FIG. 7 further includes a base timer 193, an intermediate timer 194, and an override timer 195, which comprise a first monitoring means for the second controlled product of the tank. Base timer 193 includes a timing relay coil 11TR connected in series with a pair of normally closed contacts 11TR1 between the terminals 192 and 292 of two selector switches 191 and 291. Selector switch 191 has one input terminal connected to level sensor switch 31, with additional input terminals connected to the level sensor switch 31, with additional input terminals connected to the level sensor switches 32 and 33 for stations 22 and 23 of the tank. The two selector switches 191 and 291 are ganged. One input terminal of switch 291 is connected to a terminal 252 in control 61, between solenoid 44B and relay contacts 2CR2. Similar connections are made to the other two input terminals of selector switch 291 from ratio controls 62 and 63. Accordingly, it is seen that timing relay 11TR is energized only during the times in which material is discharged to the second controlled product B, assuming the selector switches 191 and 291 to be set to select station 21 as the key station for coarse sand, as shown in FIG. 7.

The base timer 193 also includes a control relay coil 13CR connected in series with a pair of normally open timing relay contacts 11TR2 between the power lines 121 and 122. A green indicator lamp 313 is connected in parallel with coil 13CR.

The intermediate alarm timer 194 in the circuit of FIG. 7 comprises a timing relay coil 12TR connected in series with a set of normally closed timing relay contacts 12TR1 between the two selector switches 191 and 291. This timer for the second product monitoring means also comprises a control relay 14CR connected in series with a pair of normally open timing relay contacts 12TR2 between the power lines 121 and 122. A blue indicator lamp 314 is connected in parallel with coil 14CR.

The override timer 195 includes a timing relay coil 13TR connected in series with a pair of normally closed contacts 13TR1 between the two selector switches 191 and 291. Timer 195 further comprises a control relay coil 15CR connected in series with a pair of normally open contacts 13TR2 between the power lines 121 and 122; a red indicator lamp 315 is connected in parallel with coil 15CR. Coil 15CR is the operating coil for the relay that includes contacts 15CR1 in the ratio control circuit 61. Relay 15CR also includes similarly located contacts in the ratio controls 62 and 63.

The control illustrated in FIG. 7 may include two imbalance indicators 103, one having the same circuit connections as shown in FIG. 6 and the second being similar, with a separate horn and indicator lamp, but actuated by relay 14CR instead of relay 4CR. It is also necessary to duplicate the reset control 102 to provide for resetting of the timer relays 11TR–13TR in monitoring timers 193–195 and the other similar timers for the medium and fine portions of the tank.

The modified embodiment shown in FIG. 7 operates in the same manner as described above for the system of FIGS. 5 and 6 except that both the monitoring and override control functions are separated for the two specification products. As a consequence, the modification of FIG. 7 affords a somewhat tighter override control. On the other hand, it does not provide complete input monitoring because the discharge to the residual product is not taken into account by either of the two sets of monitoring circuits.

I claim:

1. In a sand classifying tank or like apparatus for classifying granular material, of the kind including a series of classification stations at which different gradations of material accumulate at varying rates, each station having controlled product outlet means for discharging material to at least one controlled product and auxiliary outlet means for discharging to an uncontrolled residual product, the classifying tank further comprising a series of level sensors, one for each classification station, each level sensor actuating the outlet means at its classification station to discharge material whenever material has accumulated to a given level at that station, and product control means for continuously controlling the relative amounts of material discharged through the controlled product outlet means of the classification stations to produce controlled product of predetermined constituency, within given tolerances, a monitoring system comprising:

first monitoring means for measuring the cumulative discharge at a first key classification station;

second monitoring means for measuring the cumulative discharge at a second key classification station;

and imbalance indicator means, coupled to both of the monitoring means, for indicating a substantial variation of extended duration in the ratio of cumulative discharges for the key classification stations representative of a change in the input gradation to the classifying tank likely to take the constituency of the controlled product out of tolerance or to cause excessive discharge to the residual product.

2. A monitoring system for a classifying tank, according to claim 1, in which each monitoring means measures the cumulative time of discharge for the key station with which the monitoring means is associated, and in which each monitoring means comprises:

a base timer which times out upon cumulative measurement of a predetermined base time interval;

an alarm timer which times out upon cumulative measurement of a predetermined imbalance time interval longer than the base time interval for that monitoring means, the alarm timer being connected to the imbalance indicator means to actuate that indicator means when the alarm timer times out;

and reset control means for resetting all of the timers when all base timers have timed out.

3. A monitoring system for a classifying tank, according to claim 2, in which each monitoring means further comprises an override timer, also reset by the reset control means, which times out upon cumulative measurement of a predetermined override time interval at least as long as the imbalance time interval, and in which the monitoring system further comprises override means, connected to the override timers and to the product control means, for actuating the product control means whenever an override timer times out to preclude further discharge to the controlled product, from at least some of the classification stations, until the reset control means resets the timers.

4. A monitoring system for a classifying tank, according to claim 3, in which the override means for each monitoring means is connected only to the product control means for a limited number of adjacent classification stations including the key station associated with that monitoring means, so that discharge to the controlled product from other classification stations is not cut off when the override timer of that monitoring means times out.

5. A monitoring system for a classifying tank, according to claim 3, in which the override means for each monitoring means is connected to the product control means for all classification stations and cuts off all discharge to the controlled product upon timing out of any override timer.

6. A monitoring system for a classifying tank, according to claim 1, in which each monitoring means includes a selector switch for selecting any one of a plurality of adjacent classification stations as the key station for that monitoring means.

7. A monitoring system for a classifying tank, according to claim 1, in which the first monitoring means is electrically connected to the level sensor for a first key classification station at the coarse end of the tank and the second monitoring means is electrically connected to the level sensor for a second key classification station at the medium or fine portion of the tank, whereby the system monitors total input to each of the key stations.

8. An input monitoring system for a sand classifying tank, according to claim 7, and further comprising third monitoring means for measuring the cumulative total discharge at a third key classification station, to all products.

9. A monitoring system for a sand classifying tank, according to claim 1, and further comprising a series of total time recorders, one for each classification station, for recording the total cumulative discharge time for each station of the tank over an extended period of time.

10. In a sand classifying tank or like apparatus for classifying granular material, of the kind including a series of classification stations at which different gradations of material accumulate at varying rates, each station having first outlet means for discharging material to a first controlled product, second outlet means for discharging material to a second controlled product, and third outlet means for discharging material to an uncontrolled residual product, the classifying tank further comprising a series of level sensors, one for each classification station, each level sensor actuating at least one outlet means at its classification station to discharge material whenever material has accumulated to a given level at that station, and product control means for continuously controlling the relative amounts of material discharged through the first and second outlet means of the classification stations to produce two controlled products of predetermined constituencies, within given tolerances, an input monitoring system comprising:

first discharge time monitoring means, electrically connected to the level sensor for a first key classification station, for measuring the cumulative total discharge time from that first key classification station to all products;

second discharge time monitoring means, electrically connected to the level sensor for a second key classification station, for measuring the cumulative total discharge time from that second key classification station to all products;

and input imbalance indicator means, coupled to the first and second monitoring means, for detecting and indicating a substantial variation of extended duration in the ratio of total cumulative discharge times for the first and second key classification stations representative of a change in the input gradation to the classifying tank sufficient to take the constituency of either controlled product out of tolerance.

* * * * *